US009837734B2

(12) United States Patent
Wang et al.

(10) Patent No.: US 9,837,734 B2
(45) Date of Patent: Dec. 5, 2017

(54) ELECTRICAL CONNECTOR HAVING INETRENGAGED GROUNDING CONTACTS

(71) Applicant: FOXCONN INTERCONNECT TECHNOLOGY LIMITED, Grand Cayman (KY)

(72) Inventors: Yong-Qi Wang, Huaian (CN); Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/476,981

(22) Filed: Apr. 1, 2017

(65) Prior Publication Data

US 2017/0288326 A1 Oct. 5, 2017

(30) Foreign Application Priority Data

Apr. 1, 2016 (CN) ..... 2016 1 0198791
Sep. 30, 2016 (CN) ..... 2016 2 1094716 U

(51) Int. Cl.

| | |
|---|---|
| ***H01R 24/00*** | (2011.01) |
| ***H01R 11/12*** | (2006.01) |
| ***H01R 13/432*** | (2006.01) |
| ***H01R 12/77*** | (2011.01) |
| ***H01R 13/434*** | (2006.01) |
| ***H01R 13/627*** | (2006.01) |

(Continued)

(52) U.S. Cl.

CPC ..... *H01R 11/12* (2013.01); *H01R 12/775* (2013.01); *H01R 13/432* (2013.01); *H01R 13/434* (2013.01); *H01R 13/5219* (2013.01); *H01R 13/6271* (2013.01); *H01R 13/6471* (2013.01); *H01R 13/6585* (2013.01); *H01R 23/7073* (2013.01)

(58) Field of Classification Search

CPC ..... H01R 23/02; H01R 24/60; H01R 24/62
USPC ..... 439/660, 607.07
See application file for complete search history.

(56) References Cited

U.S. PATENT DOCUMENTS 9,444,177 B2 9/2016 Tsai et al.
9,553,410 B2 * 1/2017 Zhao ..... H01R 13/6581
(Continued)

FOREIGN PATENT DOCUMENTS

CN 203859328 10/2014
CN 204809444 11/2015

*Primary Examiner* — Phuong Dinh
(74) *Attorney, Agent, or Firm* — Wei Te Chung; Ming Chieh Chang

(57) ABSTRACT

An electrical connector includes an insulative housing, a number of terminals and a metallic shielding plate s retained in the insulative housing, and a shielding shell attached to the insulative housing. The insulative housing has a base portion and a tongue portion extending forwardly from the base portion along an insertion direction. The terminals define a number of first contacts and second contacts. The first contacts and second contacts respectively define a pair of grounding contacts located at two sides thereof. Each grounding contact of the second contacts has a hook portion bent upwardly and extending inwardly from outmost edge thereof and located above the grounding contact of the first contacts located at the same side. A free end of the hook portion is contacted with the grounding contact of the first contacts at same side physically and electrically.

9 Claims, 18 Drawing Sheets

(51) Int. Cl.

| | |
|---|---|
| ***H01R 13/6585*** | (2011.01) |
| ***H01R 12/50*** | (2011.01) |
| ***H01R 13/6471*** | (2011.01) |
| ***H01R 13/52*** | (2006.01) |

(56) References Cited

U.S. PATENT DOCUMENTS

| | | | | |
|---|---|---|---|---|
| 2010/0261385 | A1* | 10/2010 | Zheng | H01R 23/6873 439/607.01 |
| 2014/0051303 | A1* | 2/2014 | Yu | H01R 13/46 439/660 |
| 2014/0187105 | A1* | 7/2014 | Zhao | H01R 12/707 439/733.1 |
| 2015/0207257 | A1* | 7/2015 | Dai | H01R 13/405 439/660 |
| 2015/0244099 | A1 | 8/2015 | Lee | |
| 2016/0104957 | A1 | 4/2016 | Kim et al. | |
| 2016/0141805 | A1* | 5/2016 | Zhao | H01R 13/504 439/607.01 |
| 2016/0149349 | A1 | 5/2016 | Kao et al. | |
| 2016/0204540 | A1* | 7/2016 | Chen | H01R 13/56 439/660 |
| 2016/0233594 | A1* | 8/2016 | Zhao | H01R 13/6581 |
| 2016/0294104 | A1* | 10/2016 | Zhao | H01R 13/5202 |
| 2016/0294105 | A1* | 10/2016 | Zhao | H01R 13/5202 |
| 2017/0201046 | A1* | 7/2017 | Zhao | H01R 13/26 |
| 2017/0201053 | A1* | 7/2017 | Guo | H01R 24/64 |

* cited by examiner

ELECTRICAL CONNECTOR HAVING INETRENGAGED GROUNDING CONTACTS

BACKGROUND OF THE INVENTION

1. Field of the Invention

The present invention relates to an electrical connector having a number of grounding contacts engaged to each other.

2. Description of Related Art

China Patent No. 203859328, issued on Oct. 1, 2014, discloses a reversible electrical connector including an insulative housing defining a base portion and a tongue portion extending forwardly from the base portion. The tongue portion defines opposite first and second surfaces and forms a slot. A plurality of first contacts are retained in the insulative housing and partially exposed on the first surface and a plurality of second contacts are retained in the insulative housing and partially exposed on the second surface. A metallic shielding plate includes a body portion and is located between the first contacts and the second contacts. A pair of grounding arms extend from opposite sides of the body portion, passing through the slot, to contact first and second grounding contacts.

U.S. Patent Application Publication No. 2015/0244099, published on Aug. 27, 2015, discloses a waterproof connection module including a shell that may be manufactured using die casting to improve waterproof performance.

SUMMARY OF THE INVENTION

One object of the present invention is to provide an electrical connector comprising: an insulative housing having a base portion and a tongue portion extending forwardly from the base portion along an insertion direction; a plurality of terminals retained in the insulative housing, the terminals defining a plurality of first contacts and second contacts located at two surfaces of the tongue portion, the first contacts and second contacts respectively defining a pair of grounding contacts located at two sides thereof, each grounding contact of the second contacts having a hook portion bent upwardly and extending inwardly from outmost edge thereof and located above the grounding contact of the first contacts located at the same side, a free end of the hook portion contacted with the grounding contact of the first contacts at same side physically and electrically; a metallic shielding plate retained in the insulative housing; and a shielding shell attached to the insulative housing to form a receiving space to receive the insulative housing.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
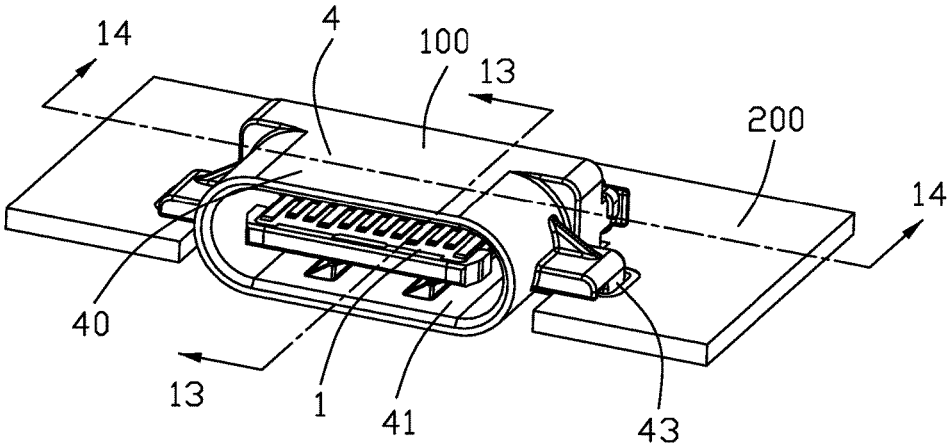
FIG. 1 is a perspective, assembled view of an electrical connector mounted upon a printed circuit board in a first embodiment.
Figure 2:
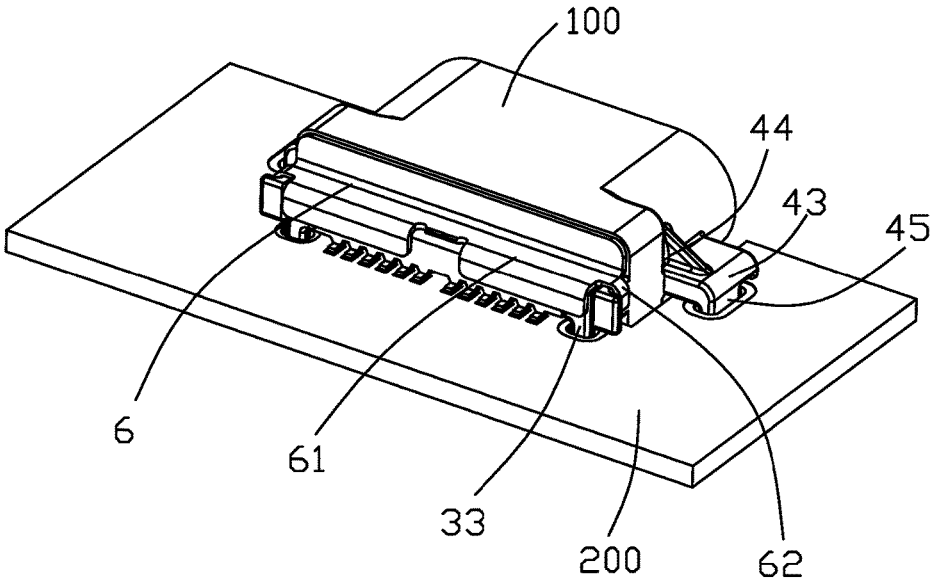
FIG. 2 is another perspective, assembled view of FIG. 1 in the first embodiment.
Figure 3:
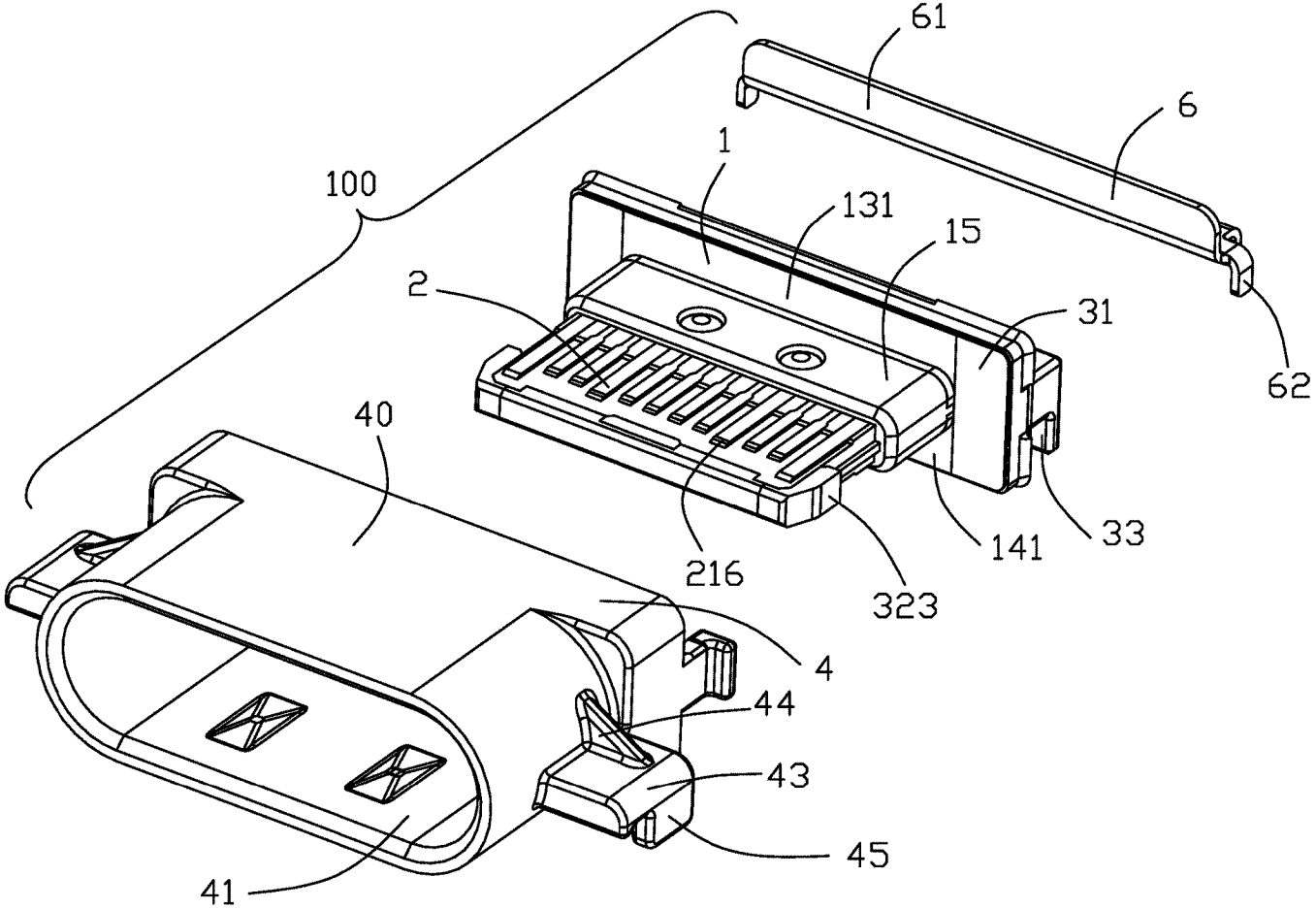
FIG. 3 is a perspective, partly exploded view of the electrical connector in the first embodiment.
Figure 4:
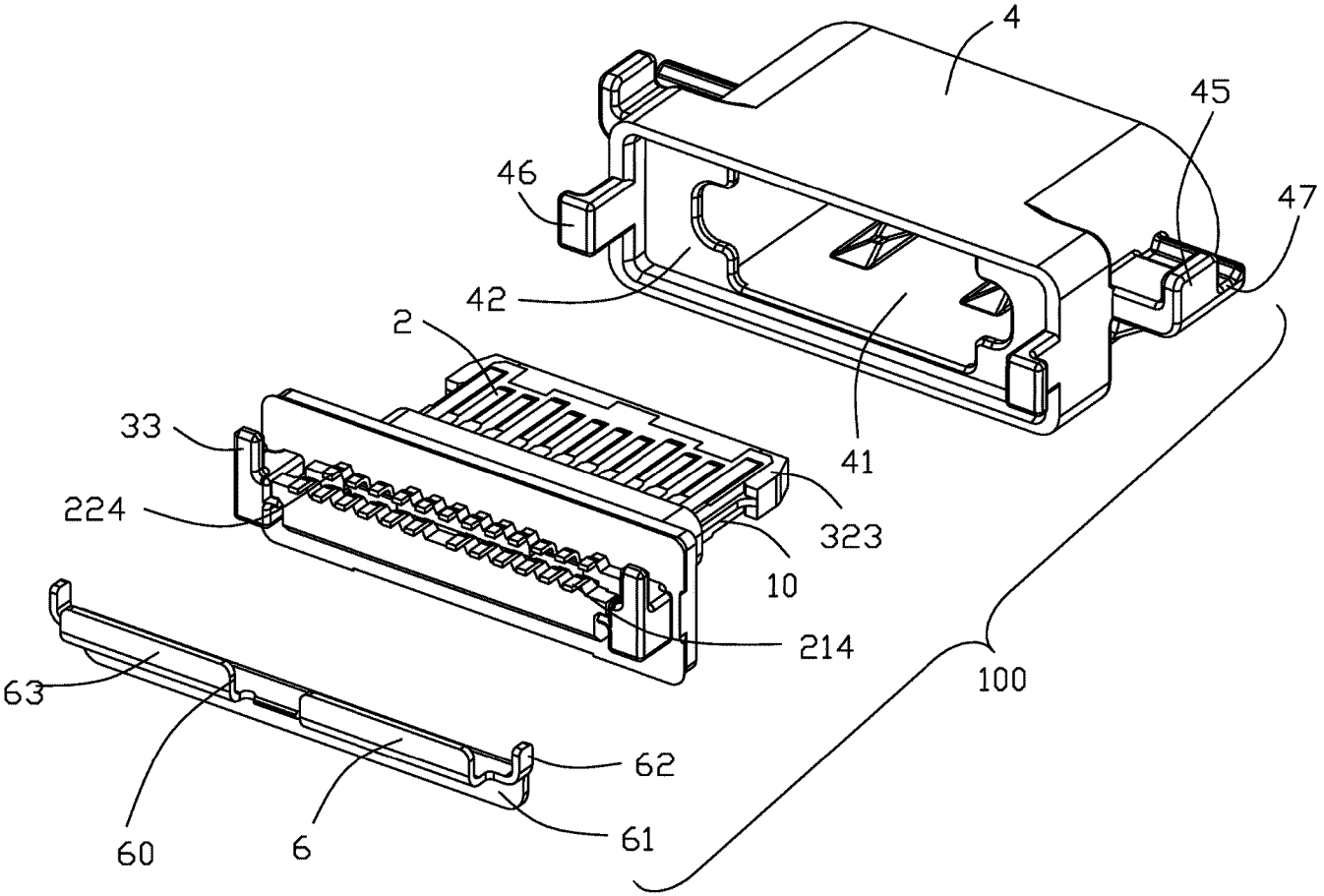
FIG. 4 is another perspective view of FIG. 3 in the first embodiment.
Figure 5:
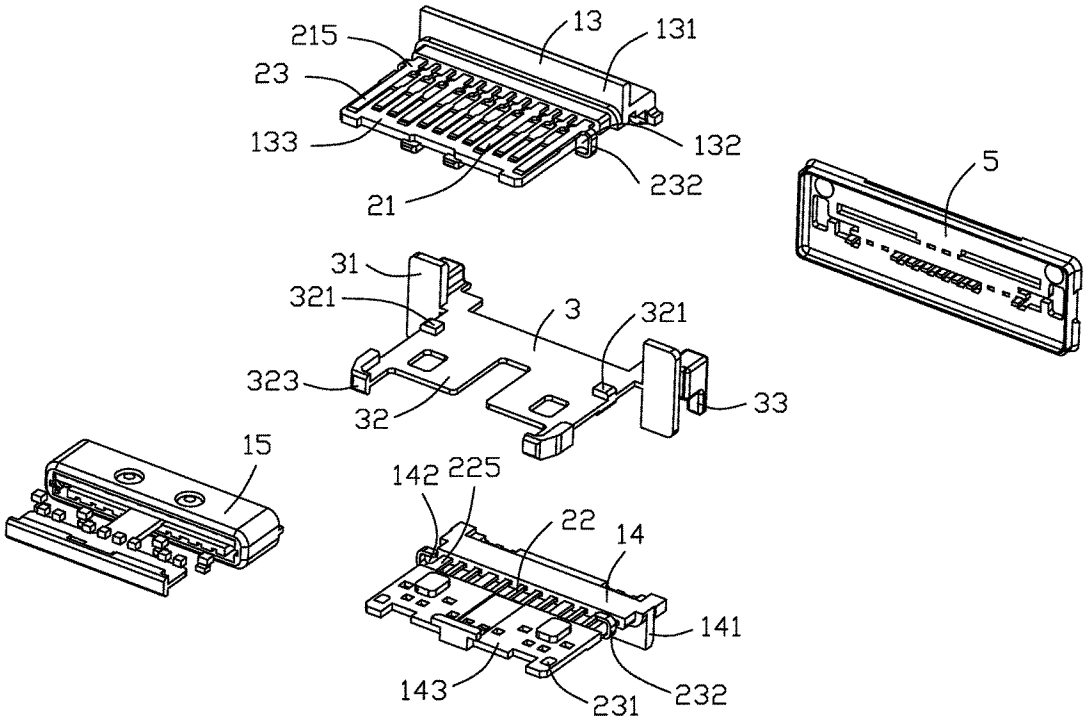
FIG. 5 is a perspective, partly exploded view of the electrical connector with no shielding shell and sub shell in the first embodiment.
Figure 6:
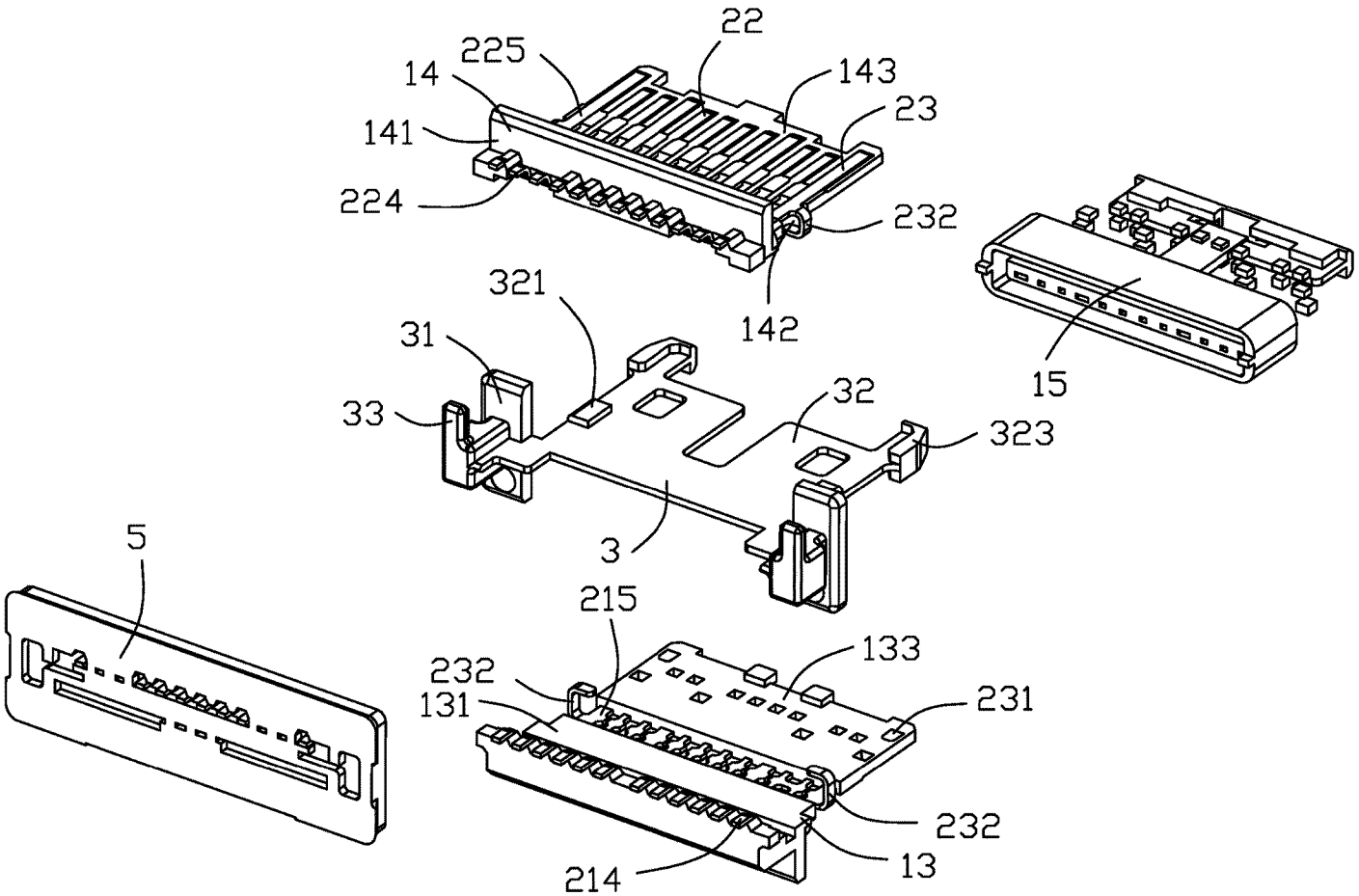
FIG. 6 is another perspective, partly exploded view of FIG. 5 in the first embodiment.
Figure 7:
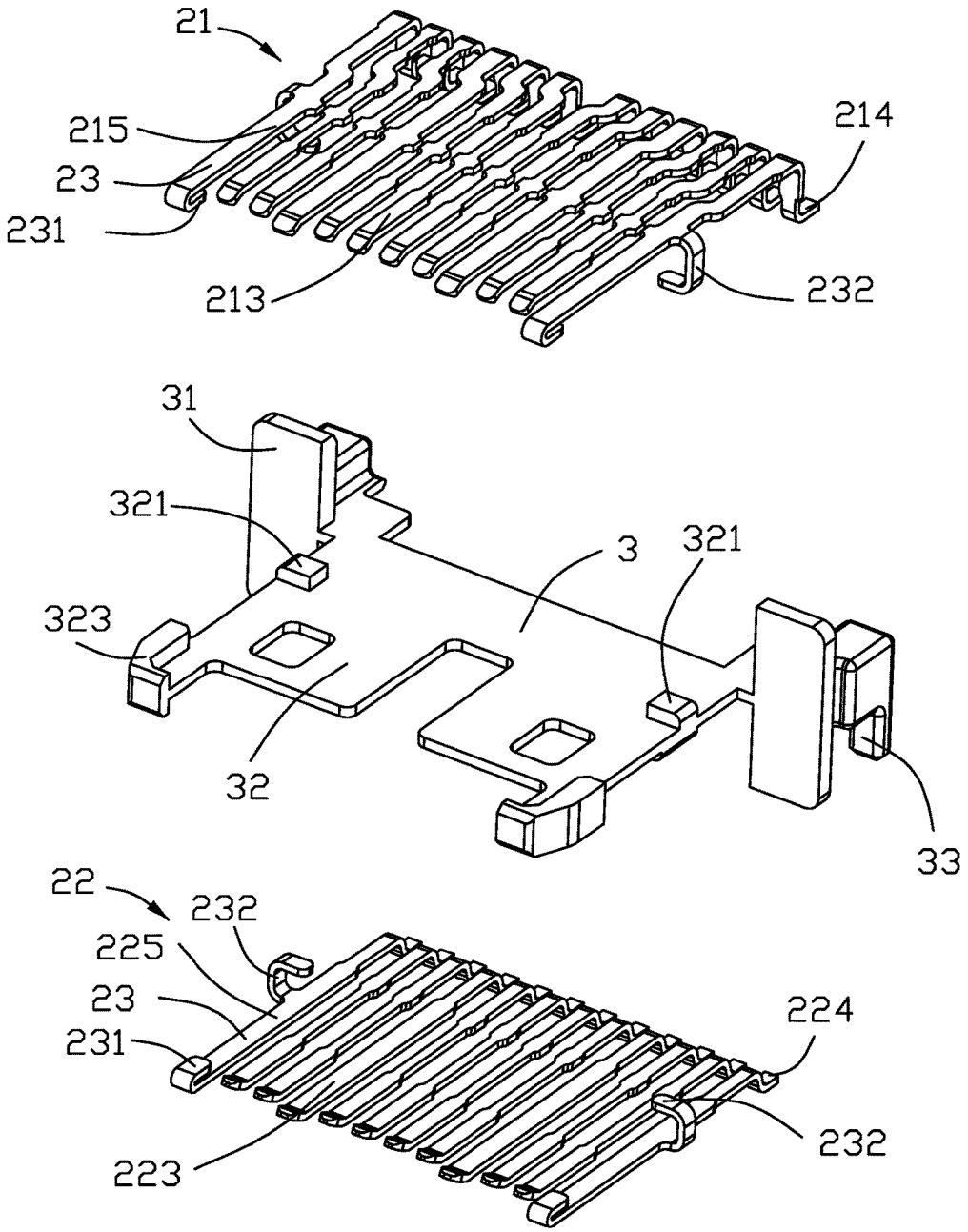
FIG. 7 is a perspective, exploded view of a number of first contacts and second contacts and a metallic shielding plate in the first embodiment.
Figure 8:
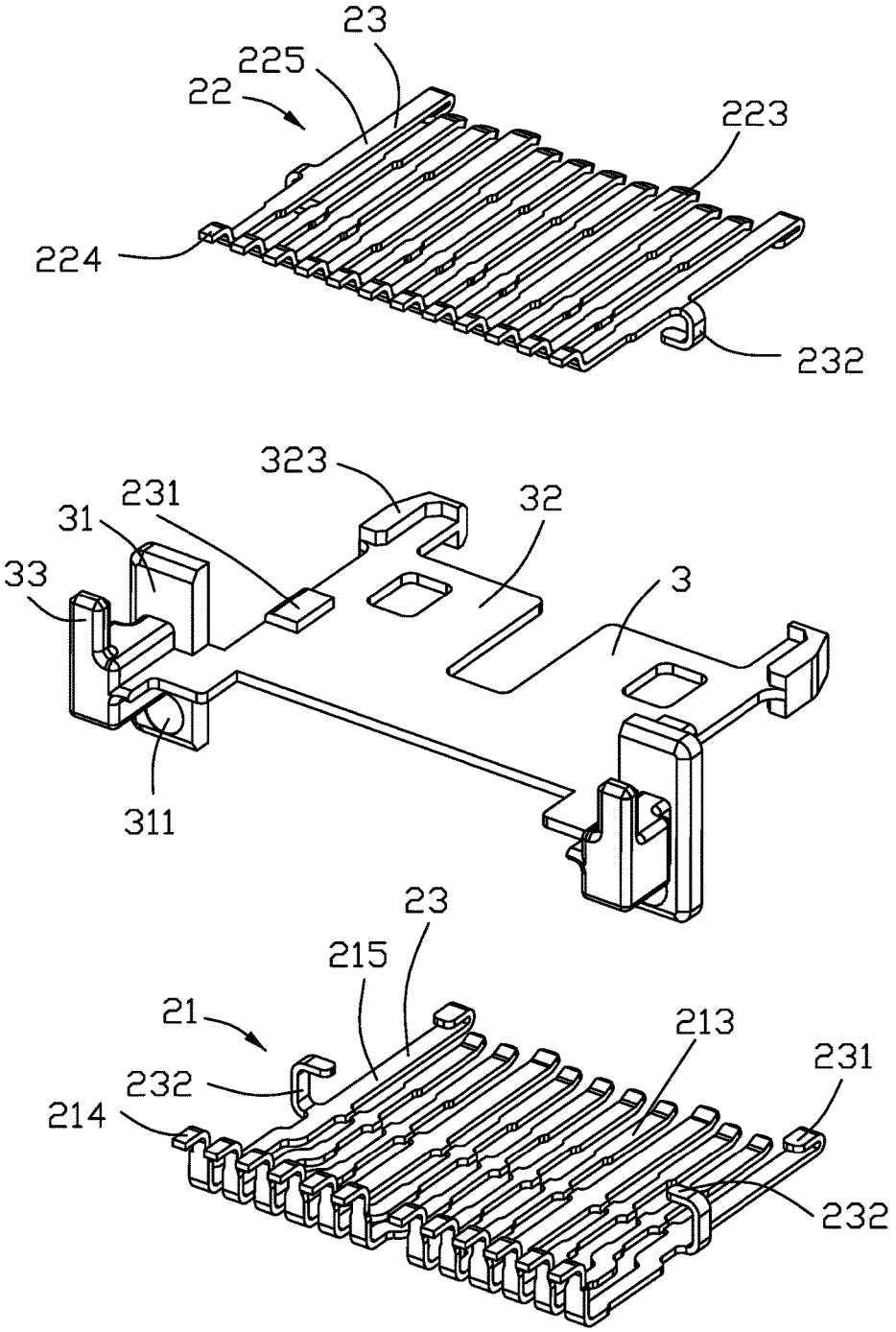
FIG. 8 is another perspective, exploded view of FIG. 7 in the first embodiment.

FIGS. 1 to 14 show an electrical connector 100 mounted upon a printed circuit board 200 and cooperated with a plug connector in a first embodiment. For convenience, the electronic connector 100 defines a mating port, an insertion direction, a transverse direction perpendicular to the insertion direction and forming a horizontal plane therebetween, and a vertical direction perpendicular to the insertion direction and the transverse direction in FIG. 1.

Referring to FIGS. 1-10, the electrical connector 100 includes a terminal module with an insulative housing 1 and a plurality of terminals 2 associated therewith, and a metallic shielding plate 3 retained in the insulative housing 1, a shielding shell 4 attached to the insulative housing 1 and forming a receiving space 41 therebetween, a glue wall 5 seal up gaps between the shielding shell 4 and the insulative housing 1, and a sub shell 6 attached to the shielding shell 4.

Referring to FIGS. 3 to 10, the insulative housing 1 includes an upper housing (unit) 13 and a lower housing (unit) 14 located oppositely, and an insulator 15 molded with the upper housing 13 and the lower housing 14. The upper housing 13 has a first base portion 131 and a first tongue portion 133 extending forwardly from the first base portion 131 and separated from the base portion 11 to form a first gap 132 filled by the insulator 15. The lower housing 14 has a second base portion 141 and a second tongue portion 143 extending forwardly from the second base portion 141 and separated from the second base portion 141 to form a second gap 142 filled by the insulator 15. The first base portion 131 and the second base portion 141 form a base portion of the insulative housing 1, and the first tongue portion 133, the second tongue portion 143, and the insulator 15 form a tongue portion of the insulative housing 1.

The terminals 2 include a number of first contacts 21 carried by the first tongue portion 133 and a number of second contacts 22 carried by the second tongue portion 143. The first contacts 21 and the second contacts 22 extending in the insertion direction respectively includes four power contacts located forwardly and eight signal contacts located backwardly. The four power contacts include a pair of Vbus contacts used to provide electric source and a pair of grounding contacts 23. The eight signal contacts includes four super-speed differential contacts located at two sides, two low-speed differential contacts located in the middle, and a pair of controlling contacts. Each of the first contacts 21 is associated with a respective one of the second contacts 22 and is positioned in reverse symmetry with respect to the second contacts 22.

Each of the first contacts 21 insert-molded with the upper housing 13 to form a module unit and includes a first contacting portion 213 exposed from the first tongue portion 133, a first soldering portion 214 exposed from a bottom surface of the first base portion 131, and a first connecting portion 215 connected with the first contacting portion 213 and the first soldering portion 214. Each of the second contacts 22 insert-molded with the lower housing 14 to form a module unit and includes a second contacting portion 223 exposed from the second tongue portion 143, a second soldering portion 224 exposed from a rear surface of the second base portion 141 and located at a same plane with the first soldering portions 214, and a second connecting portion 225 connected with the second contacting portion 223 and the second soldering portion 224. Referring to FIGS. 5 to 10, the grounding contacts 23 are located at two sides of the first contacts 21 and the second contacts 22. Each of the grounding contacts 23 of the first contacts 21 includes a tail portion 231 extending backwardly from a free end of the first contacting portion 213 and located below first contacting portion 213, and a hook portion 232 extending downwardly from an outmost edge of the first connecting portion 215 and bent inwardly to form a hook structure. Each of the grounding contacts 23 of the second contacts 22 includes a tail portion 231 extending backwardly from a free end of the second contacting portion 223 and located below second contacting portion 223, and a hook portion 232 extending downwardly from an outmost edge of the second connecting portion 215 and bent inwardly to form a hook structure or extension structure. The tail portions 231 are embedded in the first tongue portion 133 and the second tongue portion 143 and aligned with inner surfaces of the first tongue portion 133 and the second tongue portion 143. The hook portion 232 located at one side of the first contacts 21 is staggered with the hook portion 232 located at same side of the second contacts 22 along the insertion direction. The hook portions 232 of the first contacts 21 are exposed in the first gap 132 and the hook portions 232 of the second contacts 22 are exposed in the second gap 142.

The metallic shielding plate 3, in a metal stamping process or a metal injection process, includes a supporting portion 32 located between the upper housing 13 and the lower housing 14, a pair of bulges 31 located at two sides of the supporting portion 32, and a pair of soldering legs 33 extending downwardly from a rear end of the bulges 31. The bulges 31 are and located at two sides of the base portion to align a front surface of the base portion with a front surface thereof. The metallic shielding plate 3 has a number of projections 321 located at both an upper surface and a lower surface of the supporting portion 32, and a pair of end portions 323 located at two sides of a front end of the supporting portion 32. The projection 321 located at one side of the upper surface is staggered with the projection 321 located at the same side of the lower surface. The end portions 323 define a thickness bigger than that of the supporting portion 32 and covering two sides insulative housing 1 to form a pair of depressions 10 to resist a pair of springs of the plug connector. The projections 321 located at the upper surface and the lower surface of the supporting portion 32 are exposed in the first gap 132 and the second gap 142.

Figure 9:
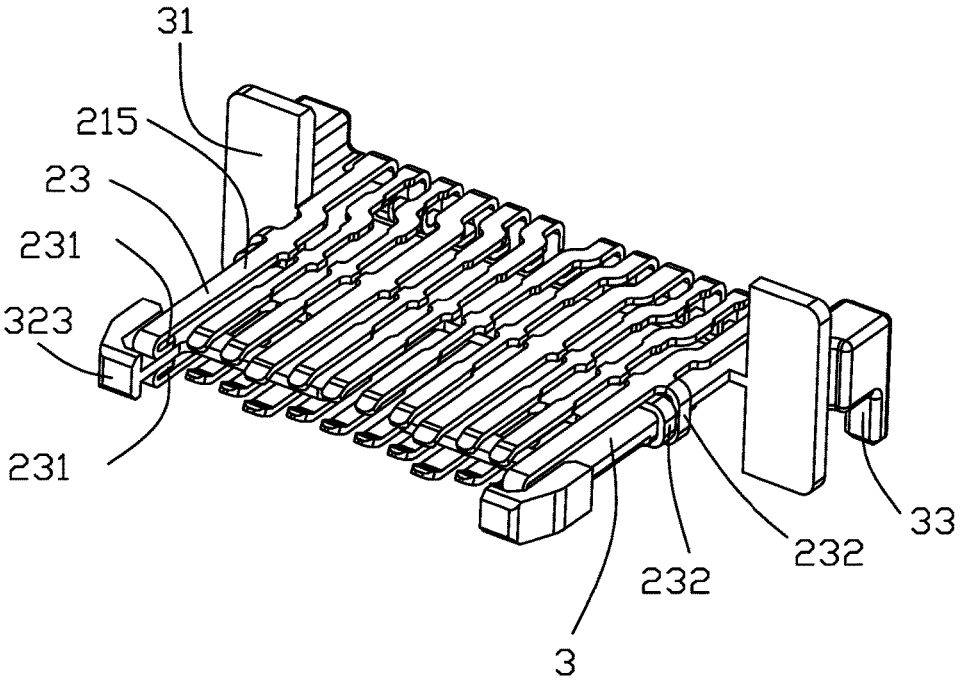
FIG. 9 is a perspective, assembled view of the first contacts and the second contacts and the metallic shielding plate in the first embodiment.
Figure 10:
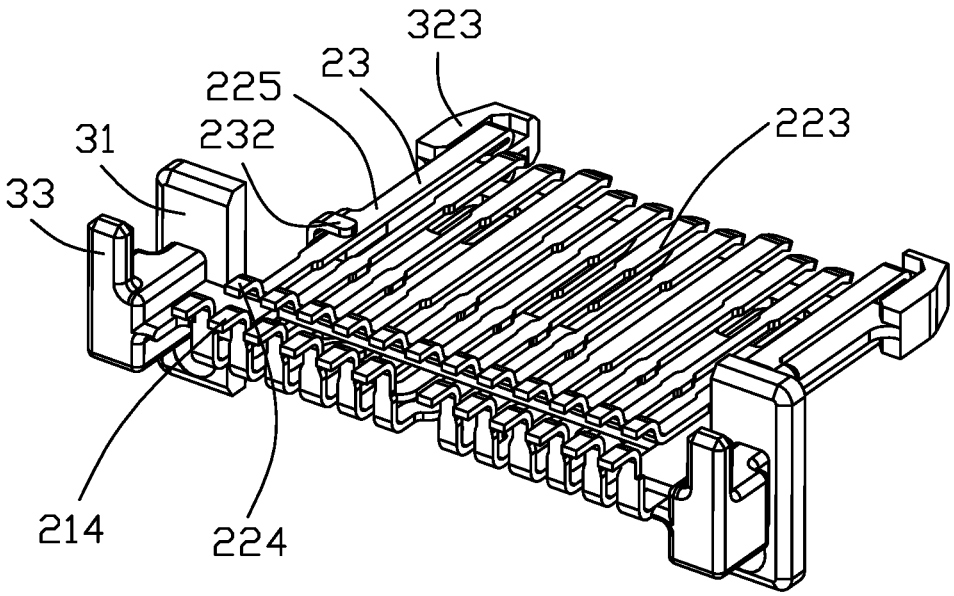
FIG. 10 is another perspective, assembled view of FIG. 9 in the first embodiment.
Figure 11:
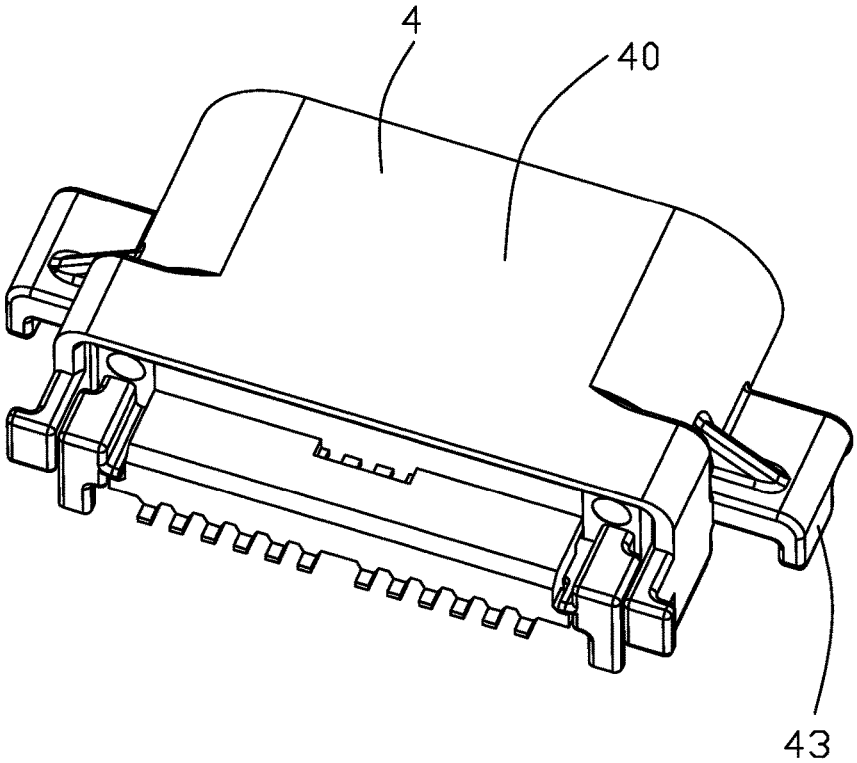
FIG. 11 is a perspective, assembled view of the electrical connector with no glue wall and sub shell in the first embodiment.
Figure 12:
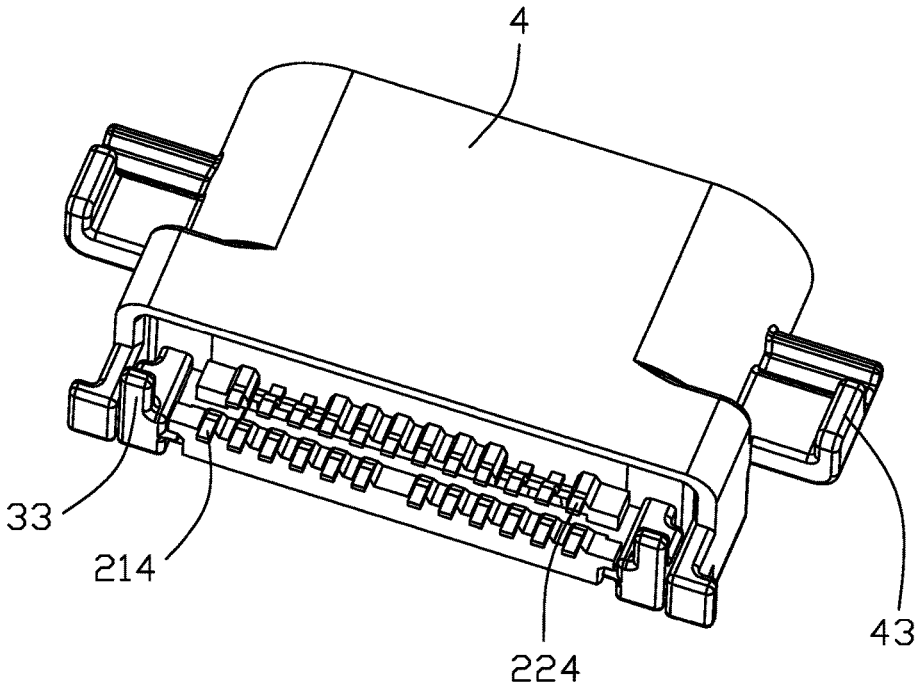
FIG. 12 is another perspective, assembled view of FIG. 11 in the first embodiment.
Figure 13:
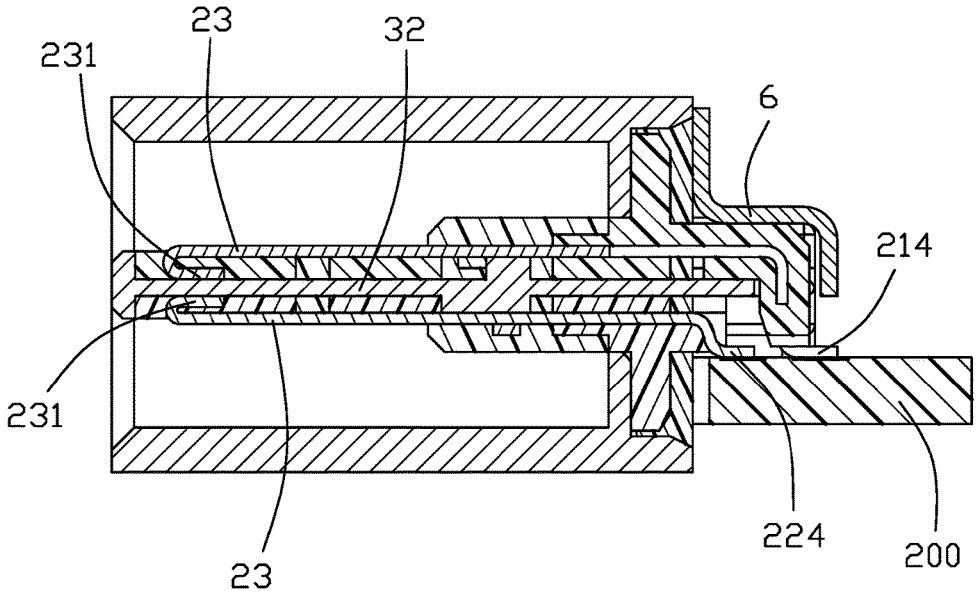
FIG. 13 is a cross-sectional view of the electrical connector along line 13-13 in FIG. 1 in the first embodiment.
Figure 14:
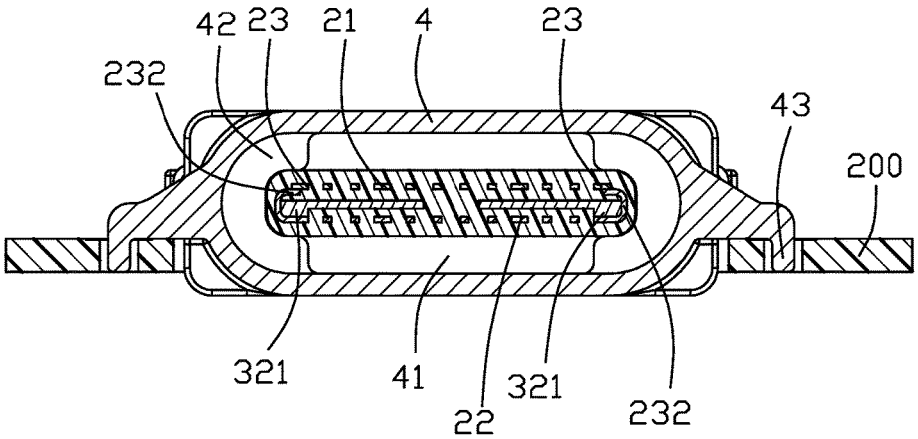
FIG. 14 is a cross-sectional view of the electrical connector along line 14-14 in FIG. 1 in the first embodiment.
Figure 15:
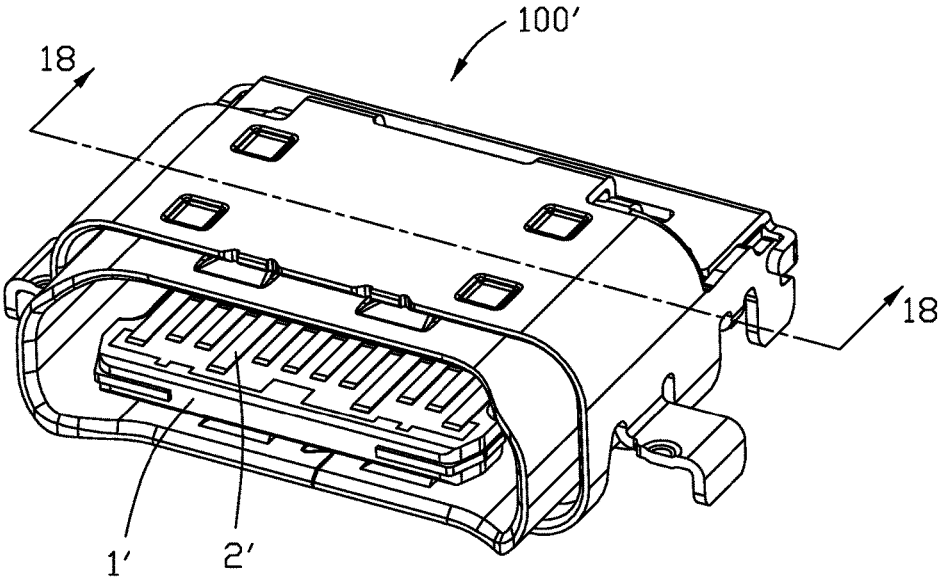
FIG. 15 is a perspective, assembled view of an electrical connector in a second embodiment.

Referring to FIGS. 9-10, and 13, bottom surfaces of the tail portions 231 of the grounding contacts 23 of the first contacts 21 contact with an upper surface of the supporting portion 32 and top surfaces of the tail portions 231 of the grounding contacts 23 of the second contacts 22 contact with a lower surface of the supporting portion 32 to contacts grounding contacts 23 of the first contacts 21 with the grounding contacts 23 of the second contacts 22 physically and electrically to attain a good performance in grounding. Referring to FIGS. 9-10, and 14, an upper surface the second connecting portion 225 of the grounding contacts 23 located in one side of the second contacts 22 contacts with a lower surface of the projection 321 located at the lower surface of the metallic shielding plate 3 in the same side and an upper surface of a free end of the hook portion 232 of the grounding contact 23 located in one side of the second contacts 22 contacts with a lower surface of the grounding contact 23 of the first contacts 21 in the same side to enclose the hook portion 232 with the projection 321 and contact the grounding contacts 23 of the first contacts 21 and the grounding contacts 23 of the second contacts 22 with the metallic shielding plate 3 physically and electrically to form a grounding structure to attain a good performance in grounding. The hook portions 232 of the grounding contacts 23 of the first contacts 21 have the same structure. The grounding structures are embedded in the insulator 15 to attain a better stability and locate the upper housing 13, the lower housing 14, and the metallic shielding plate 3 stably. Notably, the shielding plate 3 is made via die-casting or metal injection molding so as to not only reinforce the inherent structure thereof but also provide the raised structure thereof, i.e., the projection 321, thus allowing the hook portion 232 to engage the projection 321 in a pressing manner for reliable mechanical and electrical connection therebetween advantageously.

Referring to FIGS. 1-4 and 11-14, the shielding shell 4, formed in a metal injection process, i.e., the die-casting process, and separated from the metallic shielding plate 3, includes a main portion 40, an inner wall 42 located in the main portion 40 and resisting a front surface of the bulges 31 to locate the tongue portion in front of the inner wall 42, and a pair of side portions 43 located at two sides of the main portion 40. The side portion 43 has a rib 44 shaping like a triangle and connected with the main portion 40 in a right-angle side, and an affixed leg 45 extending downwardly therefrom and mounted upon the printed circuit board 200. The ribs 44 enhance soldering strength in the affixed legs 45 mounted upon the printed circuit board 200 and the side portions 43 with the respective forward extensions 47 in front of the corresponding affixed legs 45, resist an upper surface of the printed circuit board 200 to prevent the electrical connector 100 overturning. In this embodiment, the front edge of each side portion 43 is further equipped with a downward flange (not labeled) to abut against the upper surface of the printed circuit board. It is noted that the main portion 40 includes a front capsular section and a rear rectangular section wherein the affixed legs 45 for extending through the printed circuit board are formed on the front capsular section and the pair of seats 46 are formed on the rear rectangular section for sitting upon the printed circuit board.

Referring to FIGS. 1-4 and 11-14, the sub shell 6 includes a front wall 61 located close to a rear end of the base portion, a top wall 63 extending rearward from a bottom edge of the front wall 61 to locate close to an upper surface of the base portion and forming an opening 60 in a middle thereof, and a pair of affixed arms 62 extending downwardly from two sides of the top wall 62. The front wall 61 and the top wall 63 form a stepping structure to decrease locating spaces of the electrical connector 100.

Figure 16:
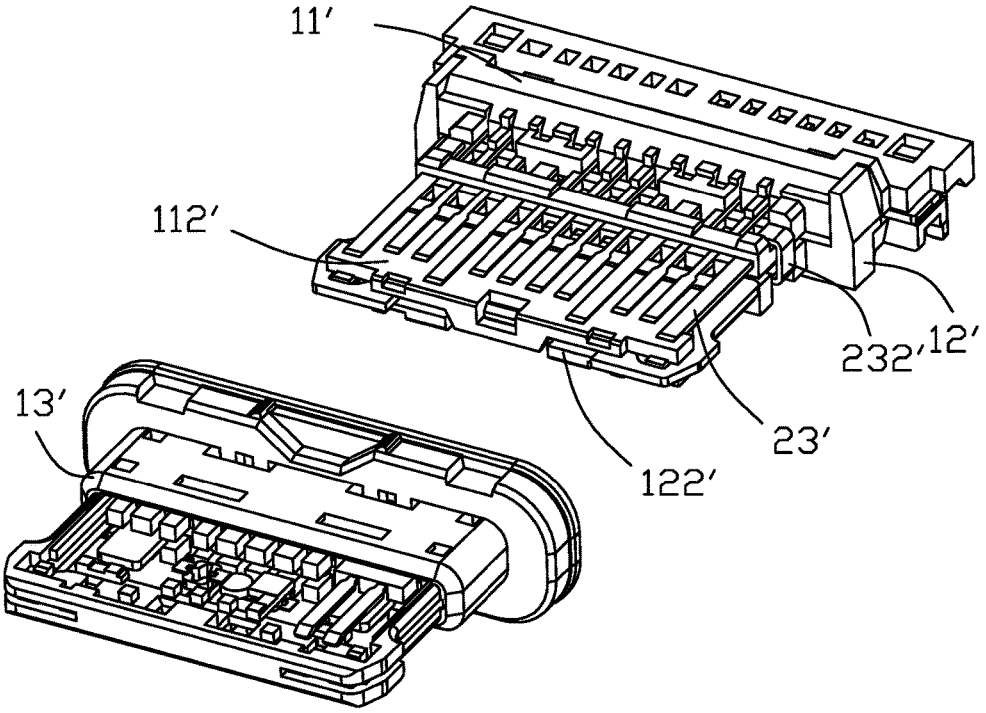
FIG. 16 is a perspective, partly exploded view of a number of first contacts and second contacts, a metallic shielding plate, and an insulative housing in the second embodiment.
Figure 17:
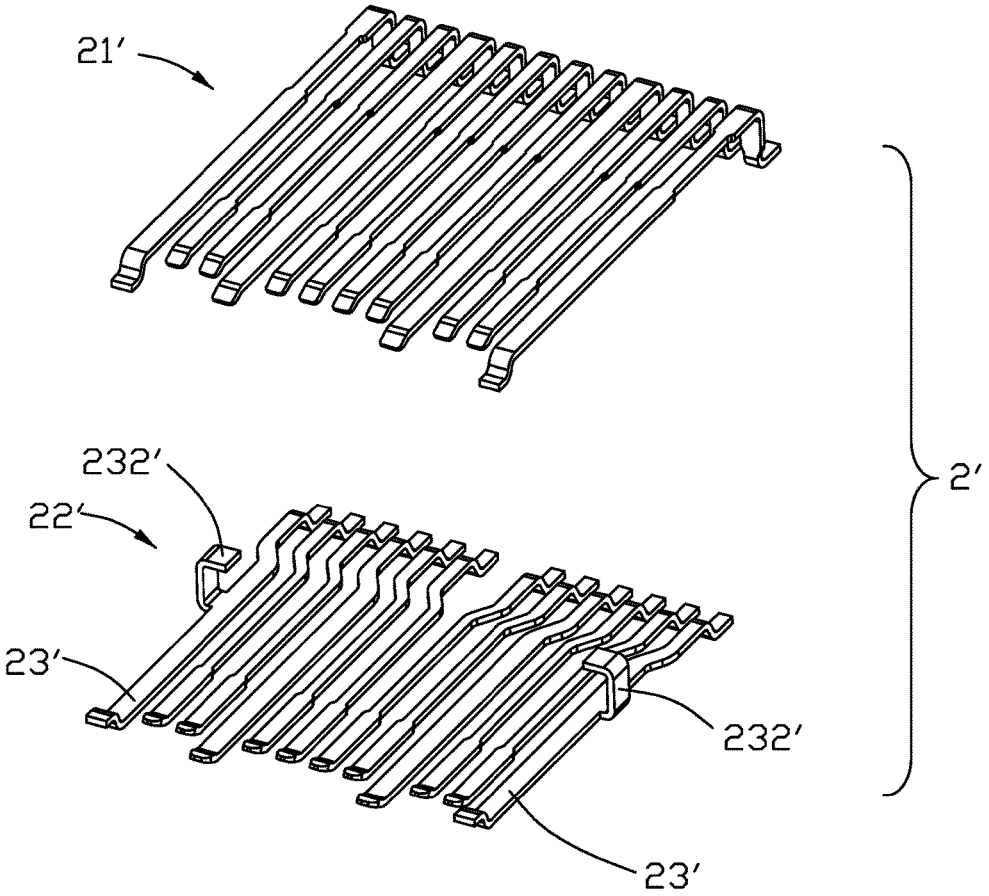
FIG. 17 is a perspective, exploded view of the first contacts and the second contacts in the second embodiment.
Figure 18:
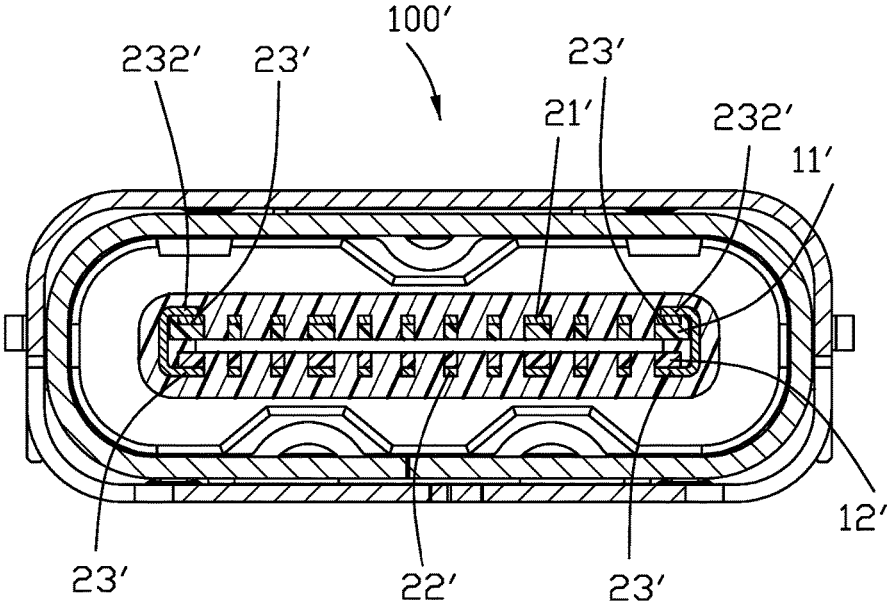
FIG. 18 is a cross-sectional view of the electrical connector along line 18-18 in FIG. 15 in the second embodiment.

FIGS. 15 to 18 show an electrical connector 100' cooperated with a plug connector in a second embodiment. The electrical connector 100' includes an insulative housing 1' and a number of terminals 2'. Referring to FIG. 16, the insulative housing 1' includes an upper housing 11' and a lower housing 12' located oppositely, and an insulator 13' over-molded with the upper housing 11' and the lower housing 12'. The upper housing 11' defines a first tongue portion 112' and the lower housing 12' defines a second tongue portion 122'. Referring to FIG. 17, the terminals 2' define a number of first contacts 21' carried by the first tongue portion 112' and a number of second contacts 22' carried by the second tongue portion 122'. The first contacts 21' and the second contacts 22' respectively define a pair of grounding contacts 23' located at two sides thereof. Each grounding contact 23' of the second contacts 22' has a hook portion 232' extending upwardly from an outmost edge thereof and bent inwardly to form a hook structure. Referring to FIG. 18, a lower surface of a free end of the hook portion 232' of the grounding contact 23' located in one side of the second contacts 22' contacts with an upper surface of the grounding contact 23' of the first contacts 21' in the same side physically and electrically to form a grounding structure to attain a good performance in grounding and enhance stability between the upper housing 11' and the lower housing 12'.

However, the disclosure is illustrative only, changes may be made in detail, especially in matter of shape, size, and arrangement of sections within the principles of the invention.

What is claimed is:

1. An electrical connector comprising:

an insulative housing having a base portion and a tongue portion extending forwardly from the base portion along an insertion direction;

a plurality of terminals retained in the insulative housing, the terminals defining a plurality of first contacts and second contacts located at two surfaces of the tongue portion, the first contacts and the second contacts respectively defining a pair of grounding contacts located at two sides thereof, each grounding contact of the second contacts having a hook portion, a free end of the hook portion being in contact with the associated grounding contact of the first contacts;

a metallic shielding plate retained in the insulative housing; and a shielding shell attached to the insulative housing to form a receiving space to receive the insulative housing, wherein said hook portion is bent upwardly and extending inwardly from an outmost edge of the grounding contact and located above an associated grounding contact of the first contacts, the metallic shielding plate has a number of projections, and an upper surface of a free end of the hook portion of the grounding contact located in one side of the second contacts is contacted with a lower surface of the grounding contact of the first contacts in the same side to enclose the hook portion with the projection and contact the grounding contacts of the first contacts and the grounding contacts of the second contacts with the metallic shielding plate physically and electrically, wherein said grounding contact of the first contacts has a hook portion bent downwardly and extending inwardly from outmost edge thereof and located below the grounding contact of the first contacts located at the same side, a lower surface of a free end of the hook portion of the grounding contact located in one side of the first contacts is contacted with an upper surface of the grounding contact of the second contacts in the same side to enclose the hook portion with the projection and contact the grounding contacts of the second contacts and the grounding contacts of the first contacts with the metallic shielding plate physically and electrically, wherein said insulative housing has an upper housing, a lower housing, and an insulator over-molded with the upper housing and the lower housing, the upper housing has a first base portion and a first tongue portion extending forwardly from the first base portion and separated from the first base portion to form a first gap, and the lower housing has a second base portion and a second tongue portion extending forwardly from the second base portion and separated from the second base portion to form a second gap, wherein said first contact has a first contacting portion, the second contact has a second contacting portion, the grounding contact has a tail portion bent backwardly therefrom, the tail portions are located at free ends of the first contacting portions and the second contacting portions of the grounding contacts, and the tail portions of the grounding contacts of the first contacts and the second contacts are located close to the metallic shielding plate and contacted with the metallic shielding plate, wherein said tail portions are respectively embedded in the first tongue portion and the second tongue portion and aligned with inner surfaces of the first tongue portion and the second tongue portion.

2. The electrical connector as claimed in claim 1, wherein said shielding shell is formed in a metal inject-molding process.

3. The electrical connector as claimed in claim 1, wherein said metallic shielding plate is formed in a metal stamping process.

4. The electrical connector as claimed in claim 1, wherein said metallic shielding plate is formed in a metal inject-molding process.

5. The electrical connector as claimed in claim 4, wherein the metallic shielding plate is insert-molded with the insulative housing and includes a pair of bulges located at two sides of the base portion, the shielding shell has an inner wall therein extending along a transverse direction perpendicular to the insertion direction, and the bulges with the base portion are located behind and resisted against by the inner wall.

6. The electrical connector as claimed in claim 1, wherein said shielding shell has a tubular main portion and a pair of side portions located at two sides of the main portion, the metallic shielding plate has a pair of soldering legs, and the side portions and the soldering legs are adapted for mounting upon a printed circuit board.

7. The electrical connector as claimed in claim 6, wherein said side portion has an affixed leg extending downwardly therefrom and located in front of the soldering legs.

8. An electrical connector comprising:

a terminal module including an insulative housing with two rows of terminals and a metallic shielding plate therein, the terminals in each row arranged in a transverse direction while each of said terminals extending along a front-to-back direction perpendicular to said transverse direction, said shielding plate located between the two rows of terminals in a vertical direction perpendicular to both said transverse direction and said front-to-back direction;

said shielding plate being made via a the metal injection molding process and having a pair of projections on two lateral sides in said transverse direction, each of said projections extending away from a flat supporting portion in said vertical direction; wherein in each row, said terminals include a pair outermost grounding contacts at two opposite ends in said transverse direction, and at least one of said pair of grounding contacts includes a hook structure to grasp the corresponding projection for both mechanical and electrical connection therebetween, wherein each row of terminals are integrally formed with a corresponding housing unit to form a module unit, and the housing units sandwich the shielding plate to be commonly unified via an insulator to form the complete terminal module, further including a metallic shielding shell enclosing said terminal module, wherein said shielding shell is made via a metal injection-molding process and includes a front capsular section with a pair of affixed legs thereon for mounting through a printed circuit board, and a rear rectangular section with a pair of seats for sitting upon the printed circuit board; wherein said shielding plate includes a pair of soldering legs located beside the corresponding seats in the transverse direction, respectively; wherein said hook structure further electrically and mechanically connects to another grounding contact in the other row.

9. An electrical connector comprising:

a terminal module including an insulative housing with two rows of terminals and a metallic shielding plate therein, the terminals in each row arranged in a transverse direction while each of said terminals extending along a front-to-back direction perpendicular to said transverse direction, said shielding plate located between the two rows of terminals in a vertical direction perpendicular to both said transverse direction and said front-to-back direction;

in each row, said terminals include a pair outermost grounding contacts at two opposite ends in said transverse direction, each of said grounding contacts having a hook structure to mechanical and electrical connect to either the shielding plate or another grounding contact opposite to said shielding plate in said vertical direction; and each row of terminals being integrally formed within a corresponding insulative housing unit vi an insert-molding process; wherein said hook structure of the grounding contact in one row of said terminals grasps the insulative housing unit integrally formed with the other row of terminals so as to have the two housing units associated with said two rows of terminals are assembled together with the shielding plate therebetween in the vertical direction, further including a metallic shielding shell made via a metal injection-molding process and including a front capsular section with a pair of affixed legs thereof for mounting through a printed circuit board, and a rear rectangular section with a pair of seats thereof for sitting upon the printed circuit board, wherein said shielding plate is made via another metal injection-molding process and has a pair of soldering legs on two lateral sides for mounting through the printed circuit board, and said soldering legs are intimately located beside the corresponding seats in the transverse direction, respectively.

* * * * *